US010539352B2

(12) United States Patent
Jonsson et al.

(10) Patent No.: US 10,539,352 B2
(45) Date of Patent: Jan. 21, 2020

(54) COMPRESSOR BEARING COOLING VIA PURGE UNIT

(71) Applicant: Carrier Corporation, Farmington, CT (US)

(72) Inventors: Ulf J. Jonsson, South Windsor, CT (US); Vishnu M. Sishtla, Manlius, NY (US); Zaffir A. Chaudhry, S. Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 818 days.

(21) Appl. No.: 14/784,478

(22) PCT Filed: Apr. 15, 2014

(86) PCT No.: PCT/US2014/034097
§ 371 (c)(1),
(2) Date: Oct. 14, 2015

(87) PCT Pub. No.: WO2014/179032
PCT Pub. Date: Nov. 6, 2014

(65) Prior Publication Data

US 2016/0054040 A1 Feb. 25, 2016

Related U.S. Application Data

(60) Provisional application No. 61/818,648, filed on May 2, 2013.

(51) Int. Cl.
*F25B 45/00* (2006.01)
*F25B 43/04* (2006.01)
(Continued)

(52) U.S. Cl.
CPC ..... *F25B 45/00* (2013.01); *F25B 1/053* (2013.01); *F25B 9/002* (2013.01); *F25B 13/00* (2013.01);
(Continued)

(58) Field of Classification Search
CPC ..... F25B 45/00; F25B 13/00; F25B 31/002; F25B 43/043; F25B 2700/04; F25B 2500/26
See application file for complete search history.

(56) References Cited

U.S. PATENT DOCUMENTS 2,891,391 A 6/1959 Kocher et al.
3,620,038 A 11/1971 Muench
(Continued)

FOREIGN PATENT DOCUMENTS

CN 101326413 A 12/2008
CN 101946091 A 1/2011
(Continued)

OTHER PUBLICATIONS

International Search Report and Written Opinion for PCT/US2014/017032, dated May 8, 2014.
(Continued)

*Primary Examiner* — Nelson J Nieves
(74) *Attorney, Agent, or Firm* — Bachman & LaPointe, P.C.

(57) ABSTRACT

A compressor (22) has a housing assembly (40) with a suction port (24), a discharge port (26), and a motor compartment (60). An electric motor (42) has a stator (62) within the motor compartment and a rotor (64) within the stator. The rotor is mounted for rotation about a rotor axis (500). One or more working impellers (44) are coupled to the rotor to be driven by the rotor in at least a first condition so as to draw fluid in through the suction port and discharge the fluid
(Continued)

from the discharge port. An inlet guide vane (IGV) array (174) is between the suction port (24) and the one or more impellers (44). One or more bearings (66, 68) support the rotor (64) and/or the one or more impellers (44). A purge unit (400) has a vapor inlet line (410) for receiving a refrigerant flow and a return line (414, 417A, 417B) for returning a contaminant-depleted refrigerant flow. A supply flowpath (407A, 407B) for supplying refrigerant to the bearings extends from the purge unit.

15 Claims, 4 Drawing Sheets

(51) Int. Cl.

| | |
|---|---|
| ***F25B 13/00*** | (2006.01) |
| ***F25B 1/053*** | (2006.01) |
| ***F25B 9/00*** | (2006.01) |
| ***F25B 49/00*** | (2006.01) |
| ***F25B 31/00*** | (2006.01) |

(52) U.S. Cl.
CPC ..... *F25B 31/002* (2013.01); *F25B 43/043* (2013.01); *F25B 49/005* (2013.01); *F25B 2500/26* (2013.01); *F25B 2700/04* (2013.01)

(56) References Cited

U.S. PATENT DOCUMENTS

| | | | | |
|---|---|---|---|---|
| 3,949,566 | A | 4/1976 | Hopkins | |
| 4,032,312 | A | 6/1977 | Anderson | |
| 4,213,307 | A | 7/1980 | Watson | |
| 4,267,705 | A | 5/1981 | Leonardi et al. | |
| 4,404,812 | A | 9/1983 | Zinsmeyer | |
| 4,671,081 | A | 6/1987 | Fujiwara et al. | |
| 4,938,664 | A | 7/1990 | Zinsmeyer | |
| 5,031,410 | A * | 7/1991 | Plzak | F25B 43/043 62/475 |
| 5,165,248 | A | 11/1992 | Sishtla | |
| 5,606,872 | A | 3/1997 | Terasaki | |
| 5,685,699 | A | 11/1997 | Holmes et al. | |
| 6,065,297 | A | 5/2000 | Tischer et al. | |
| 6,182,467 | B1 | 2/2001 | Zhong et al. | |
| 6,233,967 | B1 | 5/2001 | Seewald et al. | |
| 6,327,857 | B1 | 12/2001 | Fredriksson | |
| 6,564,560 | B2 | 5/2003 | Butterworth et al. | |
| 8,037,713 | B2 | 10/2011 | Haley et al. | |
| 8,627,680 | B2 | 1/2014 | Haley et al. | |
| 9,556,875 | B2 | 1/2017 | Haley et al. | |
| 2012/0306206 | A1 | 12/2012 | Agrawal et al. | |
| 2014/0250936 | A1 * | 9/2014 | Kaji | F25D 21/14 62/285 |
| 2014/0260350 | A1 * | 9/2014 | McMasters | F25B 45/00 62/77 |
| 2015/0033779 | A1 * | 2/2015 | Seggerman | F25B 13/00 62/115 |

FOREIGN PATENT DOCUMENTS

| | | | |
|---|---|---|---|
| EP | 1087190 | A1 | 3/2001 |
| EP | 1400765 | A2 | 3/2004 |
| EP | 1614982 | A2 | 1/2006 |
| FR | 2095320 | B1 | 6/1973 |
| WO | 93/10409 | A1 | 5/1993 |
| WO | 2007/067169 | A1 | 6/2007 |

OTHER PUBLICATIONS

Dan Albertson et al., "Purge Units for Centrifugal Chillers", Air Conditioning/Heating/Refrigeration, the NEWS, Jul. 13, 1998, BNP Media, Inc., Troy, Michigan.
"Purge Systems Operation", Technical Training Student Handbook, Dec. 2008, The Trane Company, La Crosse, Wisconsin.
International Search Report and Written Opinion for PCT/US2014/034097, dated Oct. 22, 2014.
Chinese Office action dated Aug. 14, 2017 for Chinese Patent Application No. 201480024589.7.
Chinese Office action dated Feb. 8, 2018 for Chinese Patent Application No. 201480024589.7.
Chinese Office action dated Dec. 29, 2016 for Chinese Patent Application No. 201480024589.7.
European Office action dated Mar. 20, 2017 for European Patent Application No. 14722966.0.
Chinese Office action dated Aug. 3, 2018 for Chinese Patent Application No. 201480024589.7.
Chinese Office action dated Apr. 19, 2017 for Chinese Patent Application No. 201480024589.7.

* cited by examiner

COMPRESSOR BEARING COOLING VIA PURGE UNIT

CROSS-REFERENCE TO RELATED APPLICATION

Benefit is claimed of U.S. Patent Application Ser. No. 61/818,648, filed May 2, 2013, and entitled "Compressor Bearing Cooling Via Purge Unit", the disclosure of which is incorporated by reference herein in its entirety as if set forth at length.

BACKGROUND

The disclosure relates to compressors. More particularly, the disclosure relates to bearing cooling of refrigerant compressors.

One particular use of electric motor-driven compressors is liquid chillers. An exemplary liquid chiller uses a hermetic centrifugal compressor. The exemplary unit comprises a standalone combination of the compressor, a condenser unit, an evaporator unit, the expansion device, and various additional components. Exemplary compressors are electric motor-driven hermetic or semi-hermetic compressors.

In most refrigeration systems (especially those using screw compressors and reciprocating compressors), a lubricant (e.g., oil) is added to the refrigerant. The oil may be selectively separated from the refrigerant flow and reintroduced for lubrication (e.g., separated in a mechanical separator or still and then returned to lubrication ports along the bearings. Other compressors (especially centrifugal compressors) are oil-free. In such oil-free compressors, refrigerant itself may be directed to the bearings to cool and lubricate the bearings. Exemplary bearings are ball bearing-type bearings where the balls are made from ceramic materials. The refrigerant may be drawn by a mechanical pump for delivery to the bearings.

Many chillers further include purge units for removing noncondensable contaminants from the refrigerant. A flow of refrigerant is diverted from the main refrigerant flowpath and passed into a purge tank where it is cooled to condense refrigerant while leaving noncondensable contaminants in vapor form. The vapor may be vented or pumped out of the vessel (e.g., to atmosphere). The purge unit may operate intermittently.

SUMMARY

One aspect of the disclosure involves a vapor compression system comprising a compressor comprising a housing assembly having a suction port and a discharge port and a motor compartment. An electric motor has a stator within the motor compartment and a rotor within the stator. The rotor being mounted for rotation about a rotor axis. One or more working elements are coupled to the rotor to be driven by the rotor in at least a first condition so as to draw fluid in through the suction port and discharge said fluid out from the discharge port. One or more bearings are supporting the rotor and/or the one or more working elements. One or more bearing feed passages are coupled to the bearings to pass fluid along a supply flowpath to the bearings. A first heat exchanger is coupled to the discharge port to receive refrigerant driven in a downstream direction in the first operational condition of the compressor. An expansion device is downstream of the first heat exchanger. A second heat exchanger is downstream of the expansion device and coupled to the suction port to return refrigerant in the first operating condition. A purge unit has a vapor inlet line for receiving a refrigerant flow and a return line for returning a contaminant-depleted refrigerant flow and the supply flowpath extends from the purge unit.

In additional or alternative embodiments of any of the foregoing embodiments, the supply flowpath may have a first branch extending to a first of the bearings and a second branch extending to a second of the bearings.

In additional or alternative embodiments of any of the foregoing embodiments, a weir in the purge unit may divide the supply flowpath first branch from the supply flowpath second branch.

In additional or alternative embodiments of any of the foregoing embodiments, the supply flowpath is formed by or branches from the return line.

In additional or alternative embodiments of any of the foregoing embodiments, the supply flowpath is a second supply flowpath and a first supply flowpath does not branch from the return line.

In additional or alternative embodiments of any of the foregoing embodiments, the first supply flowpath and the second supply flowpath are non-overlapping.

In additional or alternative embodiments of any of the foregoing embodiments, there is no pump along the first supply flowpath.

In additional or alternative embodiments of any of the foregoing embodiments, there is a pump along the first supply flowpath.

In additional or alternative embodiments of any of the foregoing embodiments, the purge unit comprises a compressor, a heat rejection heat exchanger downstream of the purge unit compressor along a purge unit refrigerant flowpath, an expansion device downstream of the heat rejection heat exchanger along the purge unit refrigerant flowpath, a purge condensing unit being a heat absorption heat exchanger downstream of the purge unit expansion device along the purge unit refrigerant flowpath. The purge unit refrigerant flowpath is in heat exchange relation with the refrigerant flow refrigerant received from the vapor inlet line.

In additional or alternative embodiments of any of the foregoing embodiments, the purge unit comprises a purge exhaust line extending from the purge condensing unit and a pump along the purge exhaust line for exhausting contaminants from the purge unit.

In additional or alternative embodiments of any of the foregoing embodiments, the system is a chiller.

In additional or alternative embodiments of any of the foregoing embodiments: the system has a refrigerant charge selected from the group consisting of low pressure refrigerants and medium pressure refrigerants; the system has a refrigerant charge selected from the group consisting of HFC refrigerants and HFO refrigerants; the system has a refrigerant charge selected from the group consisting of R1233zd, R1234yf, R1234ze, and R134a; and/or the mechanical pump is a gear pump, a centrifugal pump, a regenerative pump, a screw pump, or a vane pump.

In additional or alternative embodiments of any of the foregoing embodiments, the compressor is a centrifugal compressor.

In additional or alternative embodiments of any of the foregoing embodiments, a controller is configured to operate the purge unit to supply refrigerant along the supply flowpath in a start-up condition.

In additional or alternative embodiments of any of the foregoing embodiments, the controller is configured to determine an insufficiency of refrigerant flow to the bearings along another supply flowpath and, responsive to the determined insufficiency, operate the purge unit to supply refrigerant along the supply flowpath in a non-start-up condition.

In additional or alternative embodiments of any of the foregoing embodiments, the method comprises operating the purge unit to supply refrigerant along the supply flowpath in a start-up condition.

In additional or alternative embodiments of any of the foregoing embodiments, the supply of refrigerant from the purge unit is terminated after the start-up condition.

In additional or alternative embodiments of any of the foregoing embodiments, an insufficiency of refrigerant along a primary supply flowpath is determined and, responsive to the determined insufficiency, operating the purge unit to supply refrigerant along the supply flowpath in a non-start-up condition.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
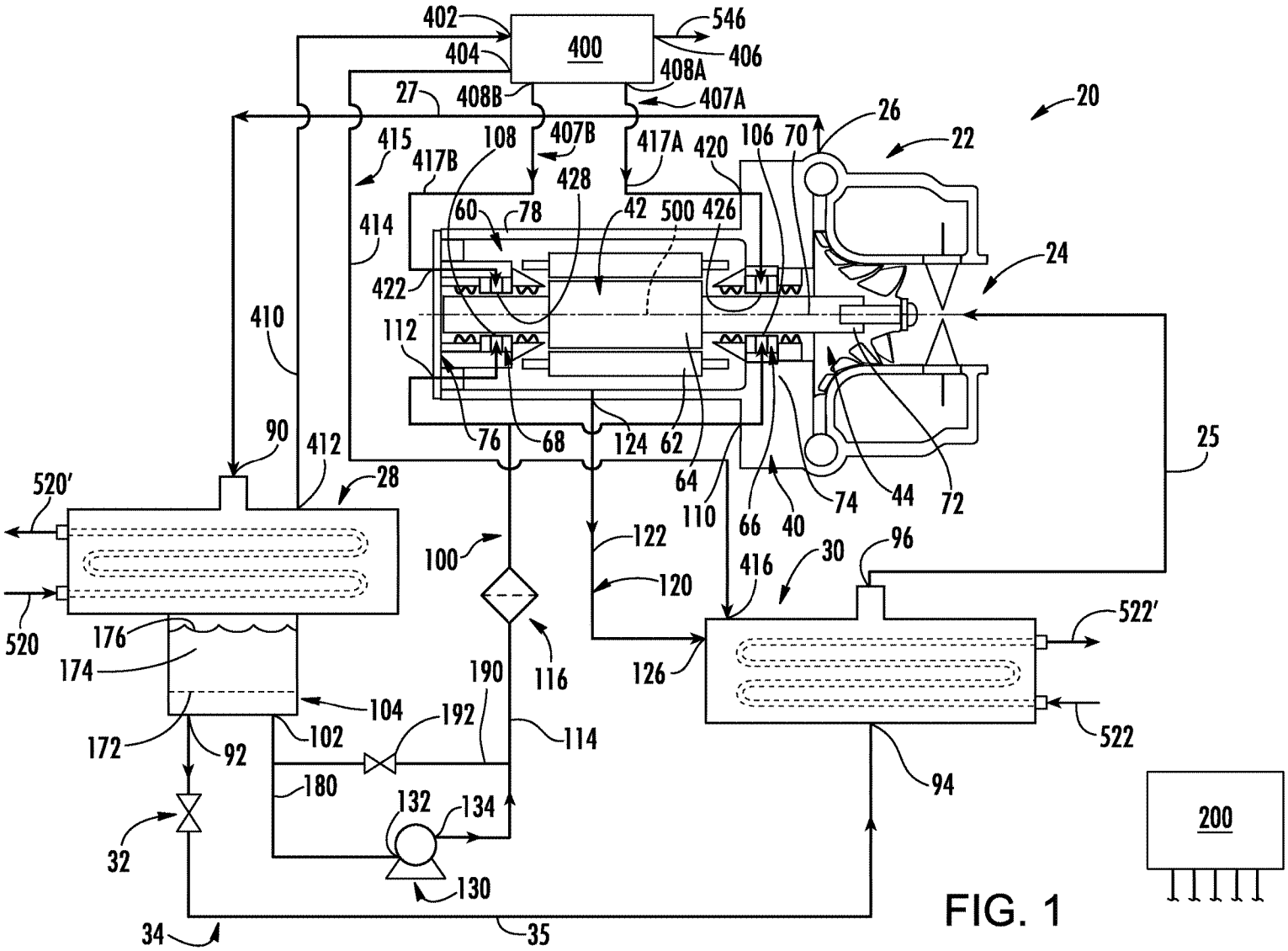
FIG. 1 is a partially schematic view of a chiller system.

FIG. 1 shows a vapor compression system 20. The exemplary vapor compression system 20 is a chiller system. The system 20 includes a compressor 22 having a suction port (inlet) 24 fed by a suction line 25 and a discharge port (outlet) 26 feeding a discharge line 27. The system further includes a first heat exchanger 28 in a normal operating mode being a heat rejection heat exchanger (e.g., a gas cooler or condenser). In an exemplary system based upon an existing chiller, the heat exchanger 28 is a refrigerant-water heat exchanger in a condenser unit where the refrigerant is cooled and condensed by an external water flow 520 (inlet), 520' (outlet).

The system further includes a second heat exchanger 30 (in the normal mode a heat absorption heat exchanger or evaporator). In the exemplary system, the heat exchanger 30 is a refrigerant-water heat exchanger for chilling a chilled water flow 522 (inlet), 522' (outlet). An expansion device 32 is downstream of the heat rejection heat exchanger and upstream of the heat absorption heat exchanger 30 along the normal mode main refrigerant flowpath 34 (the flowpath being partially surrounded by associated piping, etc. and including the suction line 25, discharge line 26, and intermediate line 35). The exemplary refrigerant-water heat exchangers 28 and 30 comprise tube bundles carrying water flow and in heat exchange relation with refrigerant passing around the bundles within the shells of the heat exchangers. The water inlets and outlets of the heat exchangers are shown unnumbered.

An exemplary compressor is a centrifugal compressor having a housing assembly (housing) 40. The housing assembly contains an electric motor 42 and one or more working elements 44 (impeller(s) for a centrifugal compressor; scroll(s) for a scroll compressor; or piston(s) for a reciprocating compressor) drivable by the electric motor in the first mode to compress fluid (refrigerant) to draw fluid (refrigerant) in through the suction port, compress the fluid, and discharge the fluid from the discharge port. The exemplary centrifugal working element(s) comprise a rotating impeller directly driven by the motor about an axis 500. Alternative centrifugal compressors may have a transmission coupling the motor to the impeller(s). Alternative compressors include screw compressors. Alternative drive systems include compressors having a drive shaft passing through a shaft seal to engage external drive means (e.g., electric or other motor).

The housing defines a motor compartment 60 containing a stator 62 of the motor within the compartment. A rotor 64 of the motor is partially within the stator and is mounted for rotation about a rotor axis 500. The exemplary mounting is via one or more bearing systems 66, 68 mounting a shaft 70 of the rotor to the housing assembly. The exemplary impeller 44 is mounted to the shaft (e.g., an end portion 72) to rotate therewith as a unit about the axis 500. The exemplary bearing system 66 mounts an intermediate portion of the shaft to an intermediate wall 74 of the housing assembly. The exemplary bearing system 68 mounts an opposite end portion of the shaft to an end wall/cover portion 76 of the housing assembly. Between the walls 74 and 76, the housing includes an outer wall 78 generally surrounding the motor compartment.

The exemplary system supplies refrigerant to cool the motor and/or lubricate bearings. FIG. 1 shows the condenser having a primary inlet 90 and a primary outlet 92. Similarly, the evaporator has a primary inlet 94 and a primary outlet 96. FIG. 1 further shows a supply flowpath 100 for delivering refrigerant to the bearings. The exemplary supply flowpath extends from condenser 28 (a second outlet 102 of the shell (e.g., of a sump 104) of the condenser in the exemplary refrigerant-water heat exchanger). Flowpath 100 extends to ports 106, 108 at the bearings 66 and 68. Flowpath 100 may enter one or more ports 110, 112 along the compressor housing (e.g., fed by branches of a supply line 114). Along the exemplary supply line 114 is a filter 116. This diverted flow of refrigerant may be returned to the main flowpath via a return flowpath or branch 120. The flowpath 120 may extend along a line 122 extending from a port 124 along the motor case to a port 126 at the shell of the heat rejection heat exchanger 30 (an exemplary refrigerant-water heat exchanger). In the illustrated example, the port 124 is open directly to the motor compartment 60 to collect refrigerant which may have bypassed seals adjacent the bearings. Alternative implementations may include return passageways extending through the housing to the bearings themselves.

To drive the supply flow, there is a mechanical pump 130. Exemplary mechanical pumps are centrifugal pumps or gear pumps with an electric motor driving the respective impeller or gears. The exemplary pump 130 has an inlet port 132 and an outlet port 134.

The exemplary sump 104 includes a screen 172. A liquid refrigerant accumulation 174 may occupy the sump extending upward to a surface 176 in the sump or in the body of the heat exchanger 28. The sump may include a float valve (not shown).

As is discussed further below, additional means may be provided for influencing flow to the bearings. These may include valves positioned to control one or more flows through the pump and/or bypass the pump. In the FIG. 1 example, a bypass line 190 extends between the lines 180 and 114 to bypass the pump 130. A valve 192 may be located along the line or at one of its ends to control flow therethrough. The line 190 may have alternative origins such as the line 35 or the sump 104. Yet alternative means for delivering flow without pumping by the pump may be provided.

In operation, the pump 130 may be used to deliver refrigerant along the flowpath 100 to the bearings. If pressure at the sump 104 or other source for the flowpath 100 is sufficiently high, the valve 192 may be opened and the pump shut off allowing refrigerant to bypass directly through the line 190 and, thereby, save the energy of running the pump.

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

FIG. 1 shows a purge unit 400 provided for removing contaminant gases from the refrigerant. The exemplary purge unit comprises an inlet 402 for receiving refrigerant from the remainder of the system (e.g., diverted from the main/primary flowpath 34) and a first outlet 404 for returning refrigerant to the remainder of the system (e.g., to the evaporator). A second outlet 406 may be a purge or vent outlet for discharging a flow 546 of contaminant gases. In the exemplary embodiment, the inlet 402 receives the refrigerant from the condenser along a line 410 extending from a port 412. The purge unit returns the refrigerant from the outlet 404 along a line 414 (e.g., along a flowpath 415 to a port 416 on the evaporator). In a conventional purge unit, the refrigerant is returned from the outlet 404 directly to the main flowpath.

However, the exemplary embodiment also allows for returning the refrigerant to the bearings. In an exemplary embodiment, an additional return flowpath 407A, 407B extends to the bearings and otherwise bypasses the main flowpath. In the exemplary embodiment, there are separate or branching flowpaths allowing switching between returning refrigerant to the bearings and returning it directly to the main flowpath. In the exemplary embodiment, the flowpaths 407A, 407B extend from outlets 408A, 408B of the purge unit 400 to feed the respective bearings 66 and 68. The flowpaths 407A, 407B pass along lines 417A, 417B. One or more valves may selectively control flow through the lines 410 and/or 414 and/or 417A, 417B. Accordingly, refrigerant stored in the purge unit may be used to cool and/or lubricate the bearings. In the exemplary selectable/switchable embodiments, this may be used on a temporary basis with returned refrigerant bypassing the bearings otherwise. Thus, the system may be controlled to return refrigerant via the bearings or via the flowpath 415 or via both. In an alternate embodiment, this is used on an exclusive basis in that all return refrigerant goes to the bearings.

In the exemplary embodiment, the flowpath 407A and its line 417A enter a port 420 on the compressor and extends to an outlet port 426 on the first bearing 66. Similarly, the flowpath 407B and its line 417B extend to a port 422 on the compressor to feed refrigerant to a port 428 along the second bearing 68. In the exemplary implementation, the port 426 is shown as distinct from the port 106 and the port 428 is shown as distinct from the port 108. However, they may in alternative embodiments be combined.

Figure 2:
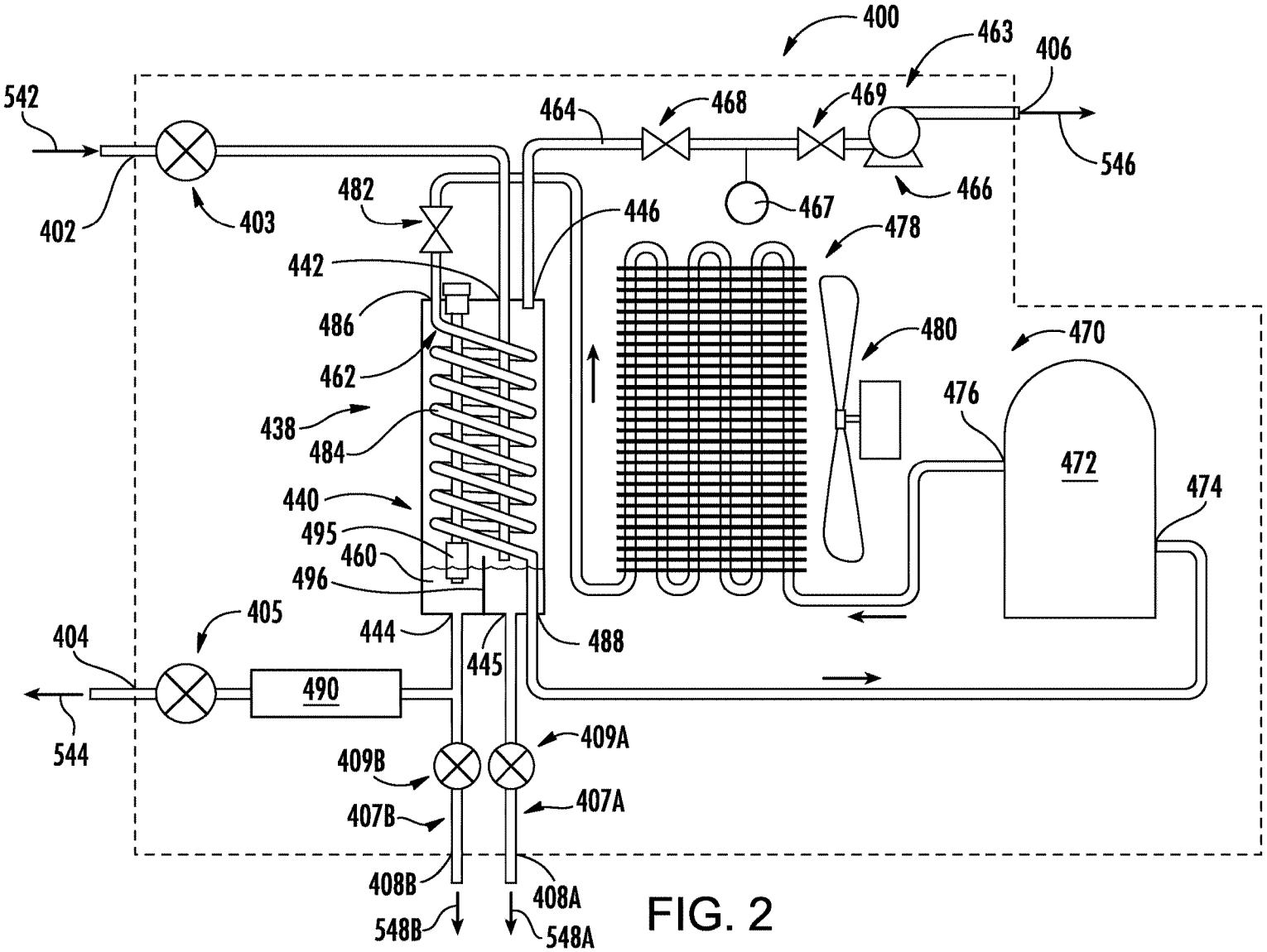
FIG. 2 is a partially schematic view of a purge unit of the chiller system of FIG. 1.

FIG. 2 has further details of the purge unit 400. Valves 403, 405, and 409A, 409B may be provided for controlling inlet flow 542, main outlet/return flow 544 and bearing cooling flows 548A, 548B, respectively. The unit includes a condensing unit 438 having a purge tank or vessel 440 having an inlet 442 receiving an inlet flow 542 and a main liquid outlet 444 providing the return flow 544. The exemplary purge tank or vessel 444 also includes an additional liquid outlet 445. In the exemplary embodiment, the liquid outlet 445 feeds the flowpath 407A, whereas the flowpath 407B is fed as a branch off of the return flowpath fed by the port 444. Alternative embodiments may have other arrangements of ports. It further includes a vapor outlet 446 providing the purge flow 546. The inlet flow 542 contains refrigerant and contaminants. In the purge tank 440, the inlet flow is cooled to condense out liquid 460 and leave a headspace 462 thereabove containing gas. The liquid is refrigerant with similarly condensable contaminants. The gas is, however, other contaminants which are not as easily condensed as the refrigerant.

A discharge (exhaust) path 463 from the port 446 to the outlet 406 may pass along a discharge (exhaust) line 464 and through a pump 466 and valves 468 and 469. The valves 468 and 469 serve to eliminate leaking of refrigerant to atmosphere when the pump 466 is not running. The use of two valves 468 and 469 facilitates a controlled leak detection method using a pressure sensor 467 between the valves 468 and 469 as is known in the art. For example, the outer/downstream valve 469 may first be closed followed by closing of the inner/upstream valve 468. Alternatively, if both valves are already closed, the inner valve may be briefly opened and then closed to equalize pressure across it. If the pressure sensor 467 then detects a pressure drop, this would indicate a leak in the outer valve or in the line between valves. Similarly, if the outer valve is opened and closed while the inner valve remains closed, any subsequent pressure increase will indicate a leak in the inner valve.

To condense refrigerant in the purge tank, means for cooling the inlet flow 542 in the purge tank 440 are provided. The exemplary means comprises an additional vapor compression system 470 having a compressor 472 having a suction port or inlet 474 and a discharge port or outlet 476. Downstream of the compressor 472 along a refrigerant flowpath of the system 470 is a heat rejection heat exchanger 478 (e.g., a refrigerant-air heat exchanger with a fan 480 driving an airflow thereacross). Downstream of the heat rejection heat exchanger 478 is an expansion device 482 (e.g., an electronic expansion valve, capillary device, or a thermal expansion valve). Downstream of the expansion device 482, a heat absorption heat exchanger 484 is in heat exchange relation with the fluid in the purge vessel 440. In the exemplary embodiment, the heat absorption heat exchanger 484 comprises a coiled tube extending through the interior of the purge tank. Thus the refrigerant flowpath of system 470 includes an inlet 486 along the tank and an outlet 488 along the tank. A suction line connects the outlet 488 to the inlet 474.

FIG. 2 further shows a filter/dryer unit 490 in a return line from the port 444 to the outlet 404. FIG. 2 further shows a sensor 495 such as a float switch for determining liquid level in the purge tank/vessel. FIG. 2 further shows a vertical weir 496 extending upward and separating a lower portion of the vessel into a first region containing the outlet 444 and a second region containing the outlet 445. This helps divide flows between the two bearings. For example, the weir may be positioned to ensure that half the condensed refrigerant falls into the first region and half into the second region (at least when there is total refrigerant level below the top of the weir). This allows one of the bearings to be fed via control of its associated valve 409A, 409B without risk of starving the other bearing.

Figure 3:
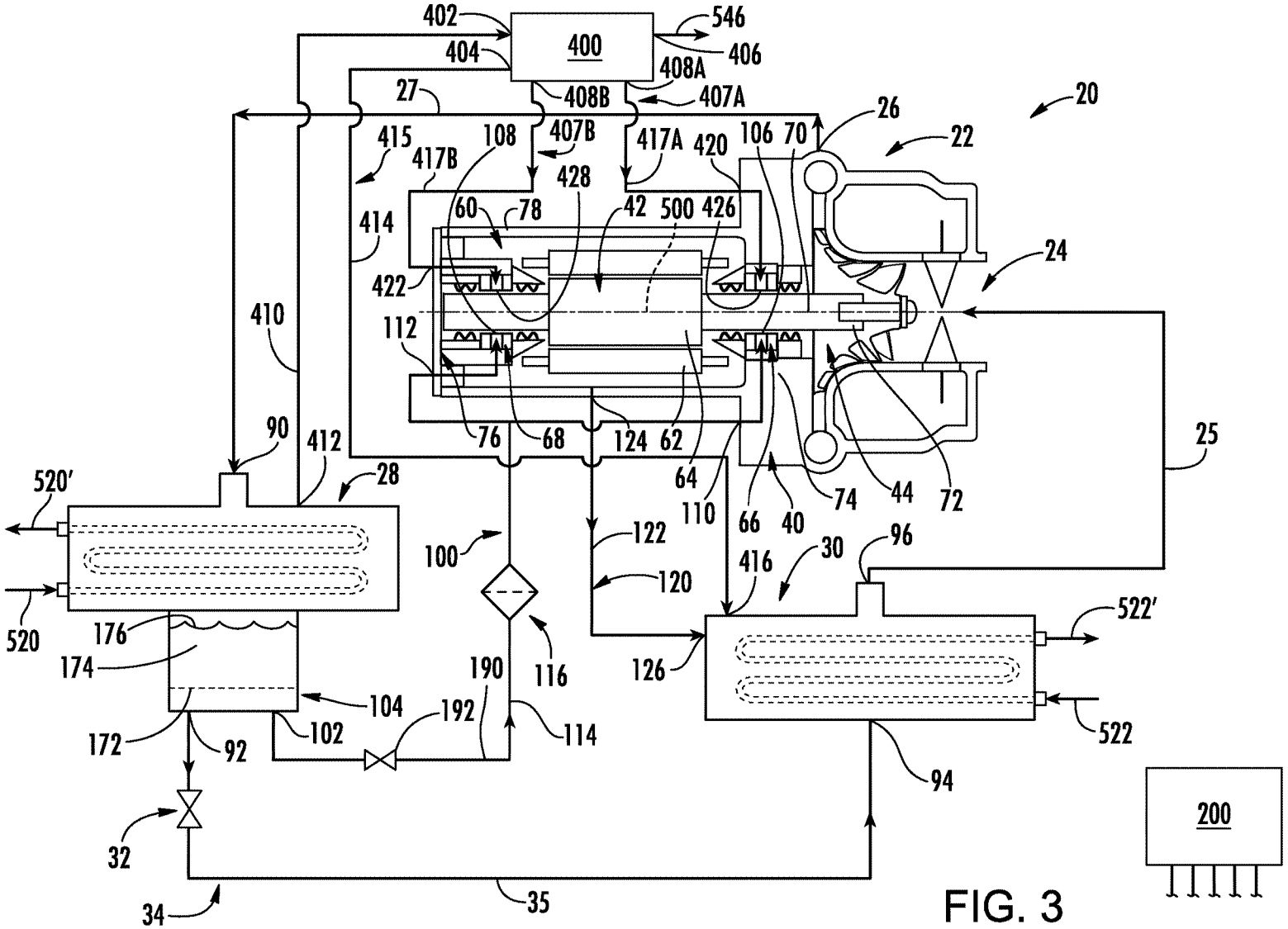
FIG. 3 is a partially schematic view of a second chiller system.
Figure 4:
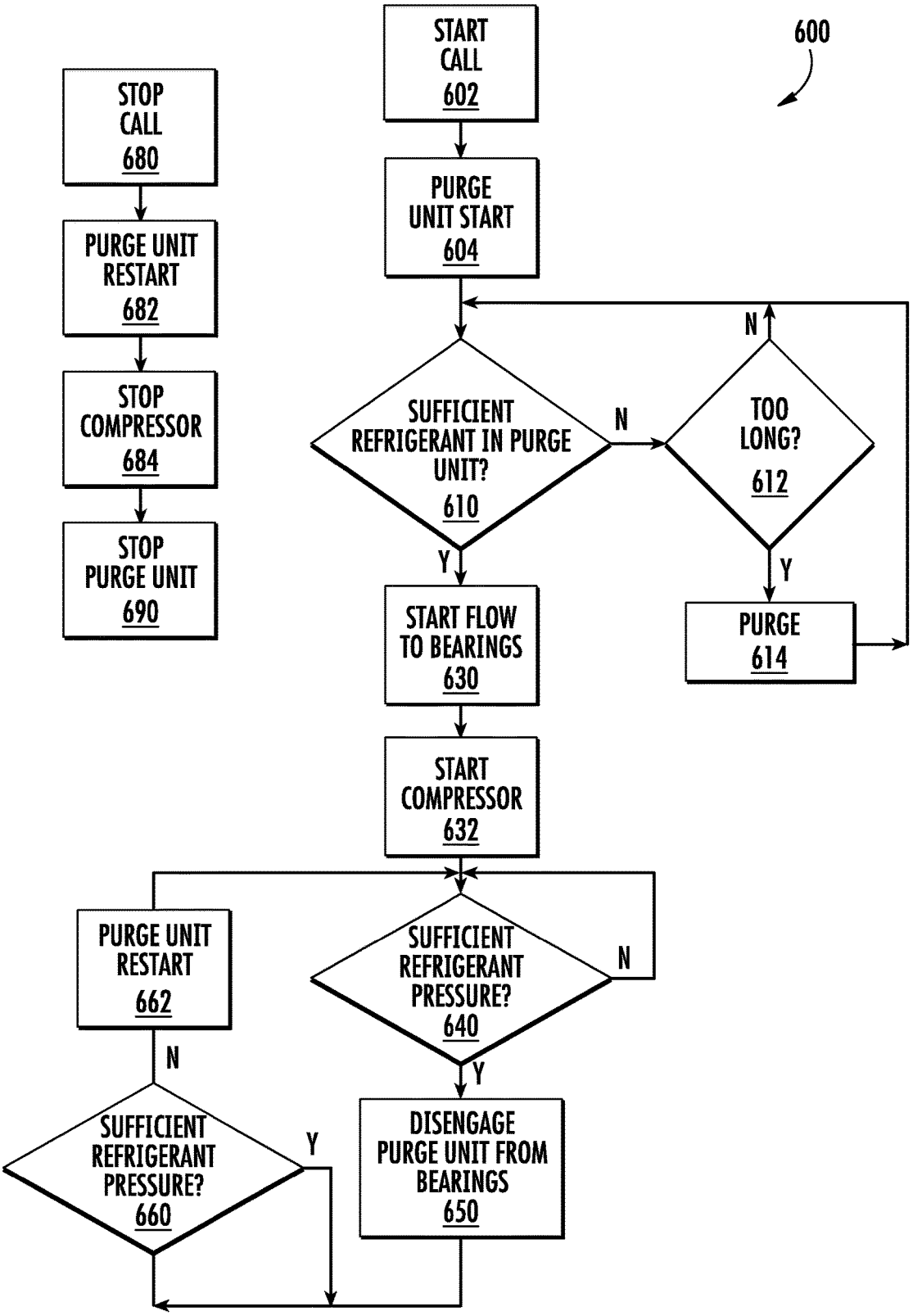
FIG. 4 is a simplified flowchart of a control routine for delivering refrigerant from the purge unit to compressor bearings in the chiller system.

The FIG. 3 system or embodiment 320 may be otherwise similar to the system or embodiment 320 of FIG. 1 except that it omits the pump 130. Such a system 320 may be appropriate when using a medium pressure refrigerant (e.g., R134a or R1234ze) rather than a low pressure refrigerant (e.g., R123 or R1233zd).

In an exemplary implementation, the purge unit is located at a height above the compressor bearings to facilitate gravity feed. In further embodiments, gravity feed is yet further eased by having no traps (e.g., P-traps) along the flowpaths 407A, 407B.

The yet further operational alternative involves configuring the control unit to fill the tank 440 to a desired threshold level and, thereafter, close valves 403 and 468. With the valves closed, heat may be added (e.g., via a resistive or other heating element) to build pressure in the vessel to drive any return flows via the ports 404 or 408A, 408B.

In an exemplary sequence of operation 600, a call to start 602 is received or entered (e.g., manually be an operator) or otherwise made (e.g., via the baseline programming of the controller). The purge unit is then started 604. The starting of the purge unit entails opening the valve 403 (if not already open) and closing the other valves (if not already closed) and starting the vapor compression system 470 (e.g., starting the compressor 472 and fan 480). The running of the vapor compression system 470 cools the purge vessel/tank and draws in further inlet flow 542. Refrigerant in the flow 542 is progressively condensed filling the accumulation in the bottom of the purge vessel. It is determined 610 (e.g., via the float switch 495) whether a threshold level of liquid refrigerant has been achieved. If the threshold is not achieved within a threshold time, it is inferred 612 that the tank contains too much non-condensable contaminants. Accordingly, the valve 468 may be opened and pump 466 run to purge 614 the contaminants. The purge may reflect a conventional purge strategy (e.g., for a given time or otherwise). Upon the liquid refrigerant threshold being reached, the valves 409A, 409B may be opened 630 to deliver refrigerant to the bearings and the compressor started 632.

Shortly, sufficient pressure will build in the condenser or other normal refrigerant source for the bearings to allow disengaging of the purge unit from the bearings. For example, an exemplary sufficient threshold pressure is a threshold of at least 5 psi (34 kPa) above the evaporator pressure (the pressure to which the bearings drain). If pressure is determined 640 sufficient, the purge unit is disengaged 650 from the bearings by closing the valves 409A, 409B and the sufficient flow then proceeding through the flowpath 100. The valve 192 (if present) may be open all this time and, even during use of the purge unit there may be some flow through that flowpath 100.

Conditions may develop wherein it is desired to restart delivery of refrigerant from the purge unit to the bearings. For example, this may be done if the condenser-to-evaporator pressure difference drops below the prior threshold (or to/below a slightly lower threshold to avoid over-cycling). For example, a slightly lower threshold of 4 psi (28 kPa) may be used in a determination 660 whereupon the purge unit is restarted 662. In an exemplary implementation, the baseline operational programming of the controller may be such that during all operation it maintains a desired amount of refrigerant in the purge unit tank to be able to instantly supply refrigerant. In such a situation, the valves 409A, 409B may be immediately open (and 405 fully or partially closed if previously open). The vapor compression system port 70 may be restarted to replenish the accumulation (if under the baseline algorithm that had not already been operating).

When a call for stop 680 is received/entered or determined, the purge unit may be turned on 682 temporarily to continue to supply refrigerant after compressor shutdown 684. This may be performed in a similar manner to the aforementioned operational restart. The purge unit may be run to supply refrigerant to the bearing for a predetermined time interval or until a threshold condition is met (e.g., a particular bearing temperature is achieved) and then stopped 690.

Although an embodiment is described above in detail, such description is not intended for limiting the scope of the present disclosure. It will be understood that various modifications may be made without departing from the spirit and scope of the disclosure. For example, when applied to the reengineering of an existing compressor or a compressor in an existing application, details of the existing compressor or application may influence details of any particular implementation. Accordingly, other embodiments are within the scope of the following claims.

What is claimed is:

1. A vapor compression system comprising:

a compressor comprising:

a housing assembly (40) having a suction port (24) and a discharge port (26) and a motor compartment (60);

an electric motor (42) having a stator (62) within the motor compartment and a rotor (64) within the stator, the rotor being mounted for rotation about a rotor axis (500);

one or more working elements (44) coupled to the rotor to be driven by the rotor in at least a first condition so as to draw refrigerant in through the suction port and discharge said refrigerant out from the discharge port;

one or more bearings (66, 68) supporting the rotor and/or the one or more working elements; and one or more bearing feed passages coupled to the bearings to pass fluid along a first supply flowpath (100) to the bearings and a second supply flowpath (407A, 407B) to the bearings;

a first heat exchanger (28) coupled to the dis charge port to receive the refrigerant driven in a downstream direction in the first operational condition of the compressor;

an expansion device (32) downstream of the first heat exchanger;

a second heat exchanger (30) downstream of the expansion device and coupled to the suction port to return the refrigerant in the first operating condition; and a purge unit (400) having:

a vapor inlet line (410) for receiving a refrigerant flow; and a return line (414, 417A, 417B) for returning a contaminant-depleted refrigerant flow, wherein the second supply flowpath (407A, 407B) extends from the purge unit, and the first supply flowpath (100) does not branch from the return line.

2. The vapor compression system of claim 1 wherein:
the second supply flowpath comprises a first branch (407A) extending to a first (66) of the bearings and a second branch (407B) extending to a second (68) of the bearings.

3. The vapor compression system of claim 1 wherein:
the second supply flowpath is formed by or branches from the return line (414, 417A, 417B).

4. The vapor compression system of claim 1 wherein:
the first supply flowpath and the second supply flowpath are non-overlapping.

5. The vapor compression system of claim 1 wherein:
there is no pump along the first supply flowpath.

6. The vapor compression system of claim 1 further comprising:
a pump (130) along the first supply flowpath.

7. The vapor compression system of claim 1 wherein the purge unit comprises:
a purge unit compressor (472);
a purge unit heat rejection heat exchanger (478) downstream of the purge unit compressor along a purge unit refrigerant flowpath;
a purge unit expansion device (482) downstream of the purge unit heat rejection heat exchanger along the purge unit refrigerant flowpath; and
a purge condensing unit (438) being a heat absorption heat exchanger downstream of the purge unit expansion device along the purge unit refrigerant flowpath and wherein the purge unit refrigerant flowpath is in heat exchange relation with the refrigerant from the refrigerant flow received from the vapor inlet line.

8. The vapor compression system of claim 7 wherein the purge unit comprises:
a purge exhaust line (464) extending from the purge condensing unit; and
a pump (466) along the purge exhaust line for exhausting contaminants from the purge unit.

9. The vapor compression system of claim 1 wherein:
the system is a chiller.

10. The vapor compression system of claim 1 wherein one or more of:
the refrigerant is selected from the group consisting of low pressure refrigerants and medium pressure refrigerants;
the refrigerant is selected from the group consisting of HFC refrigerants and HFO refrigerants; or
the refrigerant is selected from the group consisting of R1233zd, R1234yf, R1234ze, and R134a; or R134a.

11. The vapor compression system of claim 1 wherein:
the compressor is a centrifugal compressor.

12. The vapor compression system of claim 1 further comprising:
a controller (200) configured to operate (604) the purge unit to supply (630) refrigerant along the second supply flowpath in a start-up condition.

13. The vapor compression system of claim 6 wherein:
the pump is a gear pump, a centrifugal pump, a regenerative pump, a screw pump, or a vane pump.

14. A vapor compression system comprising:
a compressor comprising:
a housing assembly (40) having a suction port (24) and a discharge port (26) and a motor compartment (60);
an electric motor (42) having a stator (62) within the motor compartment and a rotor (64) within the stator, the rotor being mounted for rotation about a rotor axis (500);
one or more working elements (44) coupled to the rotor to be driven by the rotor in at least a first condition so as to draw refrigerant in through the suction port and discharge said refrigerant out from the discharge port;
one or more bearings (66, 68) supporting the rotor and/or the one or more working elements; and
one or more bearing feed passages coupled to the bearings to pass fluid along a supply flowpath to the bearings;
a first heat exchanger (28) coupled to the discharge port to receive refrigerant driven in a downstream direction in the first operational condition of the compressor;
an expansion device (32) downstream of the first heat exchanger;
a second heat exchanger (30) downstream of the expansion device and coupled to the suction port to return the refrigerant in the first operating condition; and
a purge unit (400) having:
a vapor inlet line (410) for receiving a refrigerant flow; and
a return line (414, 417A, 417B) for returning a contaminant-depleted refrigerant flow, wherein:
the supply flowpath (407A, 407B) extends from the purge unit;
the supply flowpath comprises a first branch (407A) extending to a first (66) of the bearings and a second branch (407B) extending to a second (68) of the bearings; and
a weir (496) in the purge unit divides flow between the supply flowpath first branch and second branch.

15. A vapor compression system comprising:
a compressor comprising:
a housing assembly (40) having a suction port (24) and a discharge port (26) and a motor compartment (60);
an electric motor (42) having a stator (62) within the motor compartment and a rotor (64) within the stator, the rotor being mounted for rotation about a rotor axis (500);
one or more working elements (44) coupled to the rotor to be driven by the rotor in at least a first condition so as to draw refrigerant in through the suction port and discharge said refrigerant out from the discharge port;
one or more bearings (66, 68) supporting the rotor and/or the one or more working elements; and
one or more bearing feed passages coupled to the bearings to pass fluid along a first supply flowpath (100) to the bearings and a second supply flowpath (407A, 407B) to the bearings;
a first heat exchanger (28) coupled to the discharge port to receive refrigerant driven in a downstream direction in the first operational condition of the compressor;
an expansion device (32) downstream of the first heat exchanger;
a second heat exchanger (30) downstream of the expansion device and coupled to the suction port to return the refrigerant in the first operating condition;
a purge unit (400) having:
a vapor inlet line (410) for receiving a refrigerant flow; and
a return line (414, 417A, 417B) for returning a contaminant-depleted refrigerant flow, wherein the second supply flowpath (407A, 407B) extends from the purge unit; and
a controller (200) configured to operate (604) the purge unit to supply (630) refrigerant along the supply flowpath in a start-up condition, wherein the controller is configured to:

determine (660) an insufficiency of refrigerant flow to the bearings along the first supply flowpath (100); and responsive to the determined insufficiency, operate (622) the purge unit to supply the refrigerant along the second supply flowpath in a non-start-up condition.

* * * * *